United States Patent [19]

Sheets

[11] Patent Number: 4,622,286

[45] Date of Patent: Nov. 11, 1986

[54] PHOTOIMAGING COMPOSITION CONTAINING ADMIXTURE OF LEUCO DYE AND 2,4,5-TRIPHENYLIMIDAZOLYL DIMER

[75] Inventor: Thomas M. Sheets, Wysox, Pa.

[73] Assignee: E. I. Du Pont de Nemours and Company, Wilmington, Del.

[21] Appl. No.: 776,862

[22] Filed: Sep. 16, 1985

[51] Int. Cl.[4] ..... G03C 1/52

[52] U.S. Cl. ..... 430/343; 430/344; 430/332; 430/337; 430/340

[58] Field of Search ..... 430/343, 344, 332, 334, 430/337, 340

[56] References Cited

U.S. PATENT DOCUMENTS

| | | | |
|---|---|---|---|
| 3,784,557 | 1/1974 | Cescon | 260/309 |
| 4,090,877 | 5/1978 | Streeper | 96/27 E |
| 4,311,783 | 1/1982 | Dessauer | 430/270 |

*Primary Examiner*—Won H. Louie

[57] ABSTRACT

Photoimaging composition comprising an admixture of leuco dye, and at least one 2,4,5-triphenylimidazolyl dimer prepared by an oxidative coupling reaction, a reaction product, 2,2′,5-tris-(o-chlorophenyl)-4-(3,4-dimethoxyphenyl)-4′,5′-diphenylbiimidazole, being present in an amount of 0.01 to 90.0% by weight based on the weight of solids in the composition. The composition when coated on a support is useful for prepress proofing.

25 Claims, No Drawings

PHOTOIMAGING COMPOSITION CONTAINING ADMIXTURE OF LEUCO DYE AND 2,4,5-TRIPHENYLIMIDAZOLYL DIMER

DESCRIPTION

1. Technical Field

This invention relates to a photoimaging composition. More particularly this information relates to a photoimaging composition prepared from an admixture of a leuco dye and a selectively substituted 2,4,5-triphenylimidazolyl dimer or mixtures of such dimers.

2. Background Art

Photoimaging compositions utilizing hexaarylbiimidazole compounds in admixture with a leuco dye, as well as other additives, are known. Many of these compositions are sensitive to radiation in the shorter wavelength range of the ultraviolet spectrum. New photoimaging compositions disclosed in Dessauer U.S. Pat. No. 4,311,783 consisting essentially of a leuco dye and a 2,4,5-triphenylimidazolyl dimer as defined therein exhibit spectral sensitivity in longer wavelength regions of the spectrum. In addition, the new photoimaging compositions have increased radical reactivity. Such photoimaging compositions are particularly useful in proofing papers, printout paper, overlay films, etc. It has been found, however, that the new photoimaging compositions develop an objectionable background color when allowed to deactivate slowly in low levels of ultraviolet radiation, e.g., as in a sunlight-filled office.

It is desirable that the above disadvantage be overcome and that photoimaging compositions be prepared which deactivate in diffuse sunlight without background color build-up. It is also desirable to provide a photoimaging composition which when deactivated with intense white light clearing occurs in a substantially shorter period than with known photoimaging compositions.

DISCLOSURE OF THE INVENTION

In accordance with this invention there is provided a photoimaging composition comprising an admixture of at least one 2,4,5-triphenylimidazolyl dimer which is the product of 2-(o-chlorophenyl)-4,5-diphenylimidazole and 2,4-bis-(o-chlorophenyl)-5-[3,4-dimethoxyphenyl]-imidazole by oxidative coupling, a reaction product, 2,2',5-tris-(o-chlorophenyl)-4-(3,4-dimethoxyphenyl)-4',5'-diphenylbiimidazole, being present in an amount ranging from 0.01 to 90.0% by weight based on the weight of solids in the photoimaging composition, and a leuco dye that is oxidizable to dye by the imidazolyl radicals.

In accordance with another embodiment of this invention there is provided a photoimaging composition comprising an admixture of 2,2',5-tris-(o-chlorophenyl)-4-(3,4-dimethoxyphenyl)-4',5'-diphenylbiimidazole dimer in an amount ranging from 0.01 to 90.0% by weight based on the weight of solids in the photoimaging composition, and at least one leuco dye that is oxidizable to dye by imidazolyl radicals.

The photoimaging compositions of the invention comprise at least one 2,4,5-triphenylimidazolyl dimer which is the product of the specified imidazoles disclosed above, and optionally, in addition, 2,4,5-tris-(o-chlorophenyl)-imidazole, and 2-(o-chlorophenyl)-bis-4,5-(3,4-dimethoxyphenyl)imidazole, by oxidative coupling, and a dye in its leuco form. 2,2',5-tris-(o-chlorophenyl)-4-(3,4-dimethoxyphenyl)-4',5'-diphenylbiimidazole dimer can be isolated and be present in substantially pure form in the photoimaging compositions. The photoimaging composition containing the specific 2,4,5-triphenylimidazolyl dimer or mixture of dimers, and leuco dye is stablized to prevent color build-up in the nonimage areas. The following processes have been found to be effective to achieve such stabilization: treatment with solution containing a free radical trap, e.g., hydroquinone, phenidone, etc.; inclusion in the coating of precursors of hydroquinone which lead to its generation by heat, e.g., dihydropyran adduct of ditertiarybutylhydroquinone; inclusion of quinones (photoactivatable oxidants) and hydrogen donor compounds (reductant components) which may be employed to generate hydroquinones by light exposure, preferably at a wavelength distinct from the color-forming exposure. It may be desirable to add to the photoimaging composition a film-forming polymeric binder. Suitable inert solvents are generally present in preparing the formulations and plasticizers are commonly used therein. Additional components which can be present include: antiblocking agents, dyes, and white and colored pigments which do not act as sensitizers, etc.

The substituted triphenylimidazoles which are a reactant in the preparation of 2,4,5-triphenylimidazolyl dimers can be prepared as described in Cescon U.S. Pat. No. 3,784,557, particularly column 5, lines 53 to 67 and Dessauer U.S. Pat. No. 4,311,783, particularly column 3, lines 31 to 40. The disclosures of these two patents are incorporated herein by reference.

The biimidazoles can be prepared by oxidatively coupling the triphenylimidazoles disclosed above.

One suitable oxidation method utilizes the procedure described by Hayashi et al. in Bull. Chem. Soc. Japan 33, 565 (1960) wherein the substituted triphenylimidazole in ethanolic alkali hydroxide, e.g., sodium, potassium hydroxide, is treated with aqueous alkali ferricyanide, e.g., sodium, potassium ferricyanide. The dimeric product precipitates and is isolated by filtration and washed free of ferricyanide with water.

Another method involves oxidation with halogen such as chlorine, bromine or iodine in the presence of alkali; for example, treating the potassium salt of the imidazole with iodine in ether as disclosed for other imidazoles by Zimmerman et al., Angew. Chem., 73,808 (1961).

A third oxidation method is the anodic oxidation of the imidazole in dimethylformamide or acetonitrile containing a supporting electrolyte such as alkali metal chlorate.

Difficulty may be encountered in the dimerization if the triphenylimidazole contains more than two substituents having sigma constants of 0.7 and above. The dimers obtained, however, are phototropic compounds.

The specific triphenylimidazolyl dimer or mixture of dimers are present in 0.01 to 90 percent by weight, preferably 0.1 to 10.0 percent by weight of solids in the photoimaging compositions.

The leuco form of the dye which comprises one component of a photoimaging composition of the present invention is the reduced form of the dye having one or two hydrogen atoms, the removal of which together with an additional electron in certain cases produces the dye. Such dyes have been described, for example, in U.S. Pat. No. 3,445,234, column 2, line 49 to column 8, line 55, incorporated by reference. The following classes are included:

(a) aminotriarylmethanes
(b) aminoxanthenes
(c) aminothioxanthenes
(d) amino-9,10-dihydroacridines
(e) aminophenoxazines
(f) aminophenothiazines
(g) aminodihydrophenazines
(h) aminodiphenylmethanes
(i) leuco indamines
(j) aminohydrocinnamic acids (cyanoethanes, leuco methines)
(k) hydrazines
(l) leuco indigoid dyes
(m) amino-2,3-dihydroanthraquinones
(n) tetrahalo-p,p'-biphenols
(o) 2-(p-hydroxyphenyl)-4,5-diphenylimidazoles
(p) phenethylanilines Of these leuco forms, (a) through (i) form the dye by losing one hydrogen atom, while the leuco forms (j) through (p) lose two hydrogen atoms to produce the parent dye. Aminotriarylmethanes are preferred. A general preferred aminotriarylmethane class is that of the acid salts of aminotriarylmethanes wherein at least two of the aryl groups are phenyl groups having (a) an $R_1R_2N$-substituent in the position para to the bond to the methane carbon atom wherein $R_1$ and $R_2$ are each groups selected from hydrogen, $C_1$ to $C_{10}$ alkyl, 2-hydroxyethyl, 2-cyano-ethyl, or benzyl and (b) a group ortho to the methane carbon atom which is selected from lower alkyl (C is 1 to 4), lower alkoxy (C is 1 to 4), fluorine, chlorine or bromine; and the third aryl group may be the same as or different from the first two, and when different is selected from (a) Phenyl which can be substituted with lower alkyl, lower alkoxy, chloro, diphenylamino, cyano, nitro, hydroxy, fluoro or bromo, alkylthio, arylthio, thioester, alkylsulfone, arylsulfone, sulfonic acid, sulfonamide, alkylamide, arylamide, etc.

(b) Naphthyl which can be substituted with amino, di-lower alkylamino, alkylamino;

(c) Pyridyl which can be substituted with alkyl;

(d) Quinolyl;

(e) Indolinylidene which can be substituted with alkyl.

Preferably, $R_1$ and $R_2$ are hydrogen or alkyl of 1–4 carbon atoms. Leuco dye is present in 0.1 to 5.0 percent by weight of solids in the photoimaging composition.

With the leuco form of dyes which have amino or substituted amino groups within the dye structure and which are characterized as cationic dyes, an amine salt-forming mineral acid, organic acid, or an acid from a compound supplying acid is employed. The amount of acid usually varies from 0.33 mol to 1.5 mol per mol of amino nitrogen in the dye. The preferred quantity of acid is about 0.5 to 1.3 mol per mol of amino nitrogen. Representative acids which form the required amine salts are hydrochloric, hydrobromic, sulfuric, phosphoric, acetic, oxalic, p-toluenesulfonic, trichloroacetic, trifluoroacetic and perfluoroheptanoic acid. Other acids such as acids in the "Lewis" sense or acid sources which may be employed in the presence of water or moisture include zinc chloride, zinc bromide, and ferric chloride. Representative leuco dye salts include tris-(4-diethylamino-o-tolyl)methane zinc chloride, tris-(4-diethylamino-o-tolyl)methane oxalate, tris-(4-diethylamino-o-tolyl)methane p-toluene-sulfonate and the like.

The redox couple useful in the photoimaging composition is described in U.S. Pat. No. 3,658,543, column 9, lines 1 to 46, incorporated by reference. Preferred oxidants include 9,10-phenanthrenequinone alone or in admixture with 1,6- and 1,8-pyrenequinone which absorb principally in the 430 to 550 nm region. The reductant component of the redox couple may be 100 to 10 percent of an acyl ester of triethanolamine of the formula:

$$N(CH_2CH_2OC(=O)-R)_3$$

where R is alkyl of 1 to 4 carbon atoms, and 0 to 90 percent of a $C_1$ to $C_4$ alkyl ester of nitrilotriacetic acid or of 3,3',3''-nitrilotripropionic acid. Triethanolamine triacetate and dibenzylethanolamine acetate are preferred reductant components. The molar ratios of oxidants to biimidazole used ranges from 0.01:1 to 2:1, preferably 0.2:1 to 0.6:1. The molar ratios of reductant to biimidazole used ranges from about 1:1 to about 90:1, preferably 10:1 to 20:1.

Optionally, other additives can be present in the photoimaging composition. Polymeric binders can be added to thicken the formulations or adhere them to substrates. The binders can also serve as a matrix for the color-forming composition. Light-transparent and film-forming polymers are preferred. Examples are ethyl cellulose, polyvinyl alcohol, polyvinyl chloride, polystyrene, polyvinyl acetate, poly-(methyl, propyl or butyl methacrylate), cellulose acetate, cellulose butyrate, cellulose acetate butyrate, cellulose nitrate, chlorinated rubber, copolymers of the above vinyl monomers, etc. The binder can be present in an amount from about 0.5 part to about 200 parts by weight per part of combined weight of the hexaphenylbiimidazole and leuco dye. Generally 5 to 20 parts by weight are used.

The binder composition can also contain inert infusible fillers such as titanium dioxide, organophilic colloidal silica, bentonite, powdered glass, micron-sized alumina and mica in minor, noninterfering amounts. Formulations containing micron-sized silicas, as, for example, the "Syloid" silica gels, sold by W. R. Grace & Co., are particularly useful for providing a "tooth" for pencil or ink receptivity and eliminating blocking tendencies.

With some polymers, it is desirable to add a plasticizer, e.g., solid or liquid, to give flexibility to the film or coating. Suitable plasticizers are disclosed in U.S. Pat. No. 3,658,543, column 10, lines 20 to 73, incorporated herein by reference. A preferred liquid plasticizer is nonylphenoxypoly(ethyleneoxy)-ethanol. A preferred solid plasticizer is N-ethyl-p-toluenesulfonamide. The plasticizers can be used in concentrations ranging from 1:20 to 5:3, preferably 1:5 to 1:2, based on the weight of polymeric binder used.

In preparing the formulation generally inert solvents are employed which are volatile at ordinary pressures. Examples include alcohols and ether alcohols such as methanol, ethanol, 1-propanol, 2-propanol, butanol, and ethylene glycol; esters such as methyl acetate and ethyl acetate; aromatics such as benzene, o-dichlorobenzene and toluene; ketones such as acetone, methyl ethyl ketone and 3-pentanone; aliphatic halocarbons such as methylene chloride, chloroform, 1,1,2,-trichloroethane, 1,1,2,2-tetrachloroethane and 1,1,2-trichloroethylene;

miscellaneous solvents such as dimethylsulfoxide, pyridine, tetrahydrofuran, dioxane, dicyanocyclobutane and 1-methyl-2-oxo-hexamethyleneimine; and mixtures of these solvents in various proportions as may be required to attain solutions. It is often beneficial to leave a small residue of solvent in the dried composition so that the desired degree of imaging can be obtained upon subsequent irradiation.

Useful optional antiblocking agents present to prevent the coatings from adhering to one another include $$CF_3(CF_2CF_2)_{17}CH_2CH_2-O-\overset{\overset{\displaystyle O}{\|}}{C}(CH_2)_{16}CH_3$$

and other known agents.

Still another additive is an energy-transfer dye of the type disclosed in U.S. Pat. No. 3,479,185, column 5, lines 57 to 74, incorporated herein by reference. Generally such energy-transfer dyes are present in 0.5 to 3.0% by weight based on the weight of solids including binder component, if present.

For imaging uses, the compositions of this invention may be coated upon or impregnated in substrates following known techniques. Substrates include materials commonly used in the graphic arts and in decorative applications such as paper ranging from tissue paper to heavy cardboard, films of plastics and polymeric materials such as regenerated cellulose, cellulose acetate, cellulose nitrate, polyethylene terephthalate, vinyl polymers and copolymers, polyethylene, polyvinyl-acetate, polymethyl methacrylate, polyvinylchloride; textile fabrics; glass, wood and metals. The composition, usually as a solution in a carrier solvent described above, may be sprayed, brushed, applied by a roller or an immersion coater, flowed over the surface, picked up by immersion or spread by other means, and the solvent evaporated.

Any convenient source providing radiation of wavelengths in the range of 200 nm to 400 nm can be used to activate the photoimaging composition for triphenylimidazolyl radical formation and image formation. The radiation may be natural or artificial, monochromatic or polychromatic, incoherent or coherent, and should be sufficiently intense for proper activation. Deactivation of the image occurs with visible light, 400–550 nm range.

Conventional light sources include fluorescent lamps, mercury, metal additive and arc lamps. Coherent light sources are the pulsed nitrogen-, xenon, argon ion- and ionized neon-lasers whose emissions fall within or overlap the ultraviolet or visible absorption bands of the photoinitiator. Ultraviolet and near-visible radiation-emitting cathode ray tubes widely useful in printout systems for writing on photosensitive materials are also useful with the subject compositions.

Images may be formed by writing with a beam of the activating light or by exposing to such light a selected area behind a negative, stencil, or other relatively opaque pattern. The negative may be silver on cellulose acetate or polyester film or one in which its opacity results from aggregations of areas having different refractive indices. Image formation may also be effected in conventional diazo printing apparatus, graphic arts exposure or electronic flash equipment and by projection as described in U.S. Pat. No. 3,661,461. The light exposure time may vary from a fraction of a second to several minutes, depending upon the intensity and spectral energy distribution of the light, its distance from the composition, the nature and amount of the composition available, and the intensity of color in the image desired. A preferred embodiment is described in Example 2.

INDUSTRIAL APPLICABILITY

The photoimaging compositions having the reaction product, 2,2',5-tris-(o-chlorophenyl)-4-(3,4-dimethoxyphenyl)-4'-5'-diphenylbiimidazole, are useful in dual response photoimaging products, where controlled sequential exposure with ultraviolet and visible light may yield negative or positive images, e.g., Dylux® proofing papers, printout paper, e.g., for the Du Pont aca® automatic clinical analyzer; garment pattern papers, overlay films, heatfix type papers and films. Not only do the photoimaging compositions exhibit spectral sensitivity in longer wavelength regions of the spectrum but the compositions have increased radical activity. The photoimaging compositions surprisingly when deactivated in bright sunlight do not have build-up of a color in the background areas. Upon being force deactivated, e.g., with intense white light, clearing occurs in a shorter period of time as compared with photoimaging compositions utilizing known hexaarylbiimidazole compounds. New positive mode products thus become more feasible.

EXAMPLES

The following Preparations and Examples illustrate the invention which is not limited thereby. Parts and percentages in the Preparations and Examples are by weight.

Preparation 2-(o-chlorophenyl)-4,5-diphenylimidazole

To 2.1 parts of benzil (0.01 mole) dissolved in 50 parts of glacial acetic acid containing 6 parts of ammonium acetate (0.078 mole) is added 1.4 parts of o-chlorobenzaldehyde (0.01 mole), and the solution is refluxed for 2 hours. The solution is then drowned in 200 parts of cold water whereupon 3.1 parts of reaction product precipitates. The product is isolated by filtration and purified by crystallizing twice from ethanol. The product, 2-(o-chlorophenyl)-4,5-diphenylimidazole, is a white crystalline solid having a melting point of 196° to 197° C.

Preparation 2,4-bis-(o-chlorophenyl)-5-[3,4-dimethoxyphenyl]-imidazole

A. Benzoin condensation

To a one-liter flask equipped with a stirrer, reflux condenser and nitrogen inlet tube is charged:

| Ingredient | Amount |
|---|---|
| 3,4-Dimethoxybenzaldehyde | 200 g |
| 2-Chlorobenzaldehyde | 174 g |
| Methanol | 225 ml |
| Water | 65 ml |
| Potassium cyanide | 10 g |

The system is purged with nitrogen, and the reaction mixture is refluxed for 45 minutes. The flask is cooled in an ice bath to induce crystallization which is followed by an additional 4.25 hours refluxing and cooling to room temperature with stirring. The precipitated benzoin is filtered off, is washed with a 175 ml methanol/25 ml water mixture, followed by a 1000 ml of water wash, and is then recrystallized from ethanol. There is a 69% yield of a solid with a melting point of 116°–118° C.

B. Benzil synthesis

To a 3-liter flask fitted with a stirrer, reflux condenser and thermometer, is added Mixture 1 which contains the following ingredients in the amounts indicated:

| Mixture 1 | |
|---|---|
| Ingredient | Amount (g) |
| Cupric acetate | 2.18 |
| Water | 121.0 |
| Acetic acid | 303.0 |
| Ammonium nitrate | 112.0 |

Mixture 1 is heated to about 95° C. to obtain a solution. Mixture 2 is prepared from the following ingredients in the amounts indicated:

| Mixture 2 | |
|---|---|
| Ingredient | Amount (g) |
| 3,4-Dimethoxy-2'-chlorobenzoin | 303.0 |
| Acetic acid | 909.0 |

Mixture 2 is heated to 70°–80° C. to maintain solution and is added portionwise to Mixture 1 in the flask as follows:

Portion 1: about 10% (~120 g) of Mixture 2 to start the reaction; nitrogen evolution is observed in 1 to 3 minutes.

Portion 2: About 40% (~450 g) of Mixture 2; the reaction temperature is maintained at 95° to 105° C.

Portion 3: Balance of Mixture 2 (~600 g) 1 to 2 hours after addition of Portion 2; the temperature of the mixture is held at 105° C. for an additional hour.

Following an additional five-hour reflux period to complete the reaction, the mixture is allowed to cool overnight to room conditions. The mixture is chilled to 5° to 10° C. with stirring and is filtered twice, first with a water (80 g)/acetone (320 g) solution chilled to 5° to 10° C., and then with 2000 ml of water. The filter cake is held for the preparation of the hexaphenylbiimidazole mixture.

C. Imidazole synthesis

To a 500 ml flask equipped with a stirrer, reflux condenser and nitrogen inlet tube is charged:

| Ingredient | Amount |
|---|---|
| 3,4-Dimethoxy-2'-chlorobenzil | 40.6 g |
| 2-Chlorobenzaldehyde | 20.5 g |
| Ammonium acetate | 45 g |
| Glacial acetic acid | 120 ml |

The reaction mixture is swept with nitrogen and refluxed for 12 hours and allowed to cool to room temperature overnight. The reaction mixture is then poured into 2 liters of distilled water containing 7 g of potassium bisulfite to complex the unreacted aldehyde. A white solid precipitates which is filtered, washed with 2000 ml water, and dried. N.M.R. analysis shows that the acetate salt of the imidazole formed. No attempt is made to prepare the free base because in the final step of the synthesis the oxidative dimerization is carried out in strong base and the acetate salt is converted to the base at that stage.

Imidazole Codimerization

Into a 250 ml flask equipped with stirrer and condenser is placed the following:

| Ingredient | Amount |
|---|---|
| 2-(o-chlorophenyl)-4-5-diphenylimidazole | (See Table 1 below) |
| 2-4,-bis-(o-chlorophenyl)-5-[3,4-dimethoxyphenyl]-imidazole | (See Table 1 below) |
| Methylene chloride | 125.0 ml |
| $K_3Fe(CN)_6$ | 20.7 g |
| Water | 65.0 ml |
| Sodium hydroxide (50%) | 20.0 g |

After refluxing for about 18 hours and cooling, 100 ml of water is added. The methylene chloride layer is separated and the aqueous phase is extracted with 50 ml methylene chloride. The combined methylene chloride layers are washed twice with 70 ml water and are dried over anhydrous sodium sulphate. The methylene chloride is evaporated carefully.

The residue is crystallized from methanol-water to yield a solid, mp=114°–124° C.

TABLE 1

| Compound No. | 2-(o-chlorophenyl)-4,5-diphenylimidazole (g) | 2-4-bis-(o-chlorophenyl)-5-[3,4-dimethoxyphenyl]-imidazole (g) |
|---|---|---|
| Control* | 0.0 | 20.0 |
| 1 | 1.56 | 18.0 |
| 2 | 3.12 | 16.0 |
| 3 | 7.79 | 10.0 |
| 4 | 12.5 | 4.01 |
| 5 | 14.0 | 2.00 |

*2,2'-bis-(o-chlorophenyl)-4,4',5,5'-tetraphenylbiimidazole

Table 2 summarizes the results of the codimerization.

TABLE 2

| Compound No. | 2,2',5-tris-(o-chlorophenyl)-4-(3,4-dimethoxyphenyl)-4,5'-diphenylbiimidazole (% of total biimidazoles*) |
|---|---|
| Control | 0.0 |
| 1 | 16.6 |
| 2 | 30.1 |
| 3 | 49.5 |
| 4 | 26.1 |
| 5 | 15.8 |

*area percent as determined on high pressure liquid chromatogram

Isolation of pure 2,2',5-tris-(o-chlorophenyl)-4-(3,4-dimethoxyphenyl)-4,5'-diphenylbiimidazole 2,2',5-tris-(o-chloropenyl)-4-(3,4-dimethoxyphenyl)-4,5'-diphenylbiimidazole, Compound 6, was isolated from Compound 3 above by high pressure liquid chromatography using the following conditions:

1. Sample size: 100 mg in 1.0 ml of acetonitrile.
2. Column: Zorbax ®ODS prepacked column manufactured by E. I. du Pont de Nemours and Company, Wilmington, DE, 21.2 mm I.D. by 250 mm.
3. Mode: radiant, 70% Solvent B to 95% Solvent B in 30 minutes.

4. Mobile Phase: Solvent A is water and Solvent B is acetonitrile.

5. Flow Rate: 20 ml/minute

6. Temperature: ambient

7. Equipment: Du Pont Series 8800 Liquid Chromatographic System

8. Detector: Ultraviolet (220 nm) Compound 6, isolated, had a melting point of 148.3° C. and contained 93.7% of said compound as determined by high pressure liquid chromatographic analysis.

EXAMPLE 1

This example shows the comparison of the pure biimidazole, Compound 6, with Compound 3.

Two coatings were prepared as follows:

| Ingredient | Amount (%) |
|---|---|
| Dodecylbenzene sulfonic acid | 3.08 |
| Tris-(p-diethylamino- o-tolyl) methane | 1.43 |
| N—ethyl-p-toluene sulfonamide | 11.42 |
| o-phenylphenol condensed with 2.25 moles ethylene oxide | 12.37 |
| Pyrenequinone | 0.01 |
| 9,10-phenanthrenequinone | 0.42 |
| Triethanolamine triacetate | 7.55 |
| Stearate long chain fluorinated hydrocarbon | 0.15 |
| Amorphous silica | 2.85 |
| Cellulose acetate butyrate, 38.1% butyryl, 14% acetyl, viscosity 20 seconds in ASTM units as determined by ASTM test D-1343 Method D 817 | 38.80 |
| Cellulose acetate butyrate, 38.1% butyryl, 14% acetyl, Eastman CAB 381-.5 | 19.40 |
| Biimidazole | 2.52 |

The biimidazoles used were:

Coating A, Compound 3

Coating B, Compound 6

The above compositions were laboratory coated on paper from a solution of 20% solids in 90/10 (volume/-volume) acetone/isopropanol. After drying, samples were irradiated 30 seconds through Kokomo glass using a 2 kw photopolymer source from 60 cm to yield a negative image of the artwork. The image was stabilized by exposure to the same light source through a clear, UV-blocking film (425 nm cutoff) for 75 seconds. Alternatively a positive image could be obtained by reversing the above image-producing sequence.

Density readings were made with a MacBeth RD 514 densitometer using a black filter. The results are summarized in Table 3.

TABLE 3

| | Coating | |
|---|---|---|
| | A | B |
| Coating weight (g/m$^2$) | 5.3 | 4.7 |
| Maximum density | 0.98 | 1.03 |
| Minimum density | 0.06 | 0.06 |
| Office light stability | Excellent | Excellent |

EXAMPLE 2

Six coatings were prepared as described in Example 1.

The biimidazoles used were:

| Coating | Biimidazole |
|---|---|
| C | Control (see Table 1) |
| D | Compound 1 |
| E | Compound 2 |
| F | Compound 3 |
| G | Compound 4 |
| H | Compound 5 |

The results are shown in Table 4.

TABLE 4

| | C | D | E | F | G | H |
|---|---|---|---|---|---|---|
| Coating weight (g/m$^2$) | 5.35 | 6.82 | 5.89 | 4.90 | 6.37 | 4.61 |
| Maximum density | 0.99 | 1.07 | 0.97 | 0.94 | 0.62 | 0.54 |
| Minimum density | 0.05 | 0.08 | 0.07 | 0.07 | 0.07 | 0.07 |
| Office light stability* | 0.07 | 0.04 | 0.03 | 0.02 | 0.01 | 0.02 |

*net density increase under roomlight deactivation.

EXAMPLE 3

A coating for a black proofing film was prepared as in Example 1 but with the following ingredients:

| Ingredient | Amount (%) |
|---|---|
| p-toluene sulfonic acid | 3.18 |
| 3-methoxy-4-octamidophenyl-bis-(4-diethyl-amino-2-methylphenyl/methane) | 1.55 |
| Trans-3-hydroxy-2-(p-diethylamino-benzyl) dimer | 0.54 |
| N—ethyl-p-toluene sulfonamide | 8.45 |
| o-phenylphenol condensed with 2.25 moles ethylene oxide | 9.54 |
| 9,10-phenanthrenequinone | 0.90 |
| Dibenzoethanolamine acetate | 12.45 |
| Stearate long chain fluorinated hydrocarbon | 0.15 |
| Amorphous silica | 3.60 |
| Cellulose acetate butyrate, 38.1% butyryl, 14% acetyl, viscosity 20 seconds in ASTM units as determined by ASTM test D-1343 Method D817 | 37.16 |
| Cellulose acetate butyryl, 14% acetyl, Eastman CAB 381-.5 | 18.59 |
| Biimidazole-Compound 3 | 3.89 |

The results are shown below:

Coating weight (g/m$^2$): 17.8

Maximum density: 1.09

Minimum density: 0.06

Office light stability: Good

EXAMPLE 4

A coating for printout paper was prepared as described in Example 1, but with the following ingredients:

| Ingredient | Amount (%) |
|---|---|
| Dodecylbenzene sulfonic acid | 3.22 |
| Tris(p-diethylamino-o-tolyl) methane | 1.49 |
| N—ethyl-p-toluene sulfonamide | 13.41 |
| o-phenylphenol condensed with 2.25 moles ethylene oxide | 12.29 |
| Pyrenequinone | 0.01 |
| 9,10-phenanthrenequinone | 0.44 |
| Triethanolamine triacetate | 7.49 |
| Stearate long chain fluorinated | 0.15 |

-continued

| Ingredient | Amount (%) |
|---|---|
| hydrocarbon | |
| Amorphous silica | 2.85 |
| Cellulose acetate butyrate, 38.1% butyryl, 14% acetyl, viscosity 20 seconds in ASTM units as determined by ASTM test D-1343 Method D 817 | 37.34 |
| Cellulose acetate butyrate, 38.1% butyryl, 14% acetyl, Eastman CAB 381-.5 | 18.66 |
| Biimidazole-Compound 3 | 2.65 |

The results are shown below:

Coating weight (g/m$^2$): 8.31
Maximum density: 0.98
Minimum density: 0.05
Office light stability: Excellent

EXAMPLE 5

The following ingredients were used:

| Ingredient | Amount (%) |
|---|---|
| p-toluene sulfonic acid | 2.28 |
| Tris-(p-diethylamino-o-tolyl) methane | 2.00 |
| N—ethyl-p-toluene sulonamide | 10.02 |
| p-Cresol condensed with 1.5 moles ethylene oxide | 9.98 |
| 9,10-phenanthrene quinone | 0.67 |
| Dibenzoethanolamine acetate | 10.02 |
| Stearate long chain fluorinated hydrocarbon | 0.17 |
| Cellulose acetate butyrate, 38.1% butyryl, 14% acetyl viscosity 20 seconds in ASTM units as determined by ASTM test D-1343 Method D817 | 61.33 |
| Biimidazole-Compound 3 | 3.53 |

A solution of 17.8% solids in 90/10 methyl chloride/isopropanol was coated on film to form a coating for blue registration film. After drying, the samples were treated as in Example 1. The results are shown below.

Coating weight (g/m$^2$): 22.2
Maximum density: 1.09
Minimum density: 0.06
Office light stability: Good

I claim:

1. A photoimaging composition comprising an admixture of 2,4,5-triphenylimidazolyl dimers which are the product of 2-(o-chlorophenyl)-4,5-diphenylimidazole and 2,4-bis-(o-chlorophenyl)-5-[3,4-dimethoxyphenyl]-imidazole by oxidative coupling, a reaction product being 2,2',5-tris-(o-chlorophenyl)-4-(3,4-dimethoxyphenyl)-4',5'-diphenylbiimidazole, said admixture of dimers being present in an amount ranging from 0.01 to 90.0% by weight based on the weight of solids in the photoimaging composition, and a leuco dye that is oxidizable to dye by the imidazolyl radicals.

2. A photoimaging composition comprising an admixture of 2,4,5-triphenylimidazolyl dimers which are the product of 2-(o-chlorophenyl)-4,5-diphenylimidazole; 2,4-bis-(o-chlorophenyl)-5-[3,4-dimethoxyphenyl]-imidazole; 2,4,5-tris-(o-chlorophenyl)-imidazole; and 2-(o-chlorophenyl)-bis-4,5-(3,4-dimethoxyphenyl)-imidazole by oxidative coupling, a reaction product, being 2,2',5-tris-(o-chlorophenyl)-4-(3,4-dimethoxyphenyl)-4',5'-diphenylbiimidazole, said admixture of dimers being present in an amount ranging from 0.01 to 90.0% by weight based on the weight of solids in the photoimaging composition, and a leuco dye that is oxidizable to dye by the imidazolyl radicals.

3. A photoimaging composition according to claim 1 having present at least one leuco dye which has one to two removable hydrogens, the removal of which forms a differently colored compound, with the proviso that when the leuco form has only one removable hydrogen and the resultant dye is cationic, there is also present a mineral acid, organic acid or acid-supplying compound which forms a salt with the leuco form of the dye.

4. A photoimaging composition according to claim 3 wherein the leuco dye is the salt of an acid in leuco form of a triphenylmethane dye having, in at least two of the phenyl rings positioned para to the methane carbon atom, a substituent selected from the group consisting of amino, and $C_1$ to $C_4$ dialkyl amino groups, the acid being a mineral acid, an organic acid, or an acid-supplying compound.

5. A photoimaging composition according to claim 1 wherein a film-forming polymeric binder is present.

6. A photoimaging composition according to claim 5 wherein the polymeric binder is cellulose acetate butyrate.

7. A photoimaging composition comprising an admixture of 2,2',5-tris-(o-chlorophenyl)-4-(3,4-dimethoxyphenyl)-4,',5'-diphenylbiimidazole in an amount ranging from 0.01 to 90.0% by weight based on the weight of solids of in the photoimaging composition and at least one leuco dye that is oxidizable to dye by imidazolyl radicals.

8. A photoimaging composition according to claim 1 wherein a precursor of hydroquinone which leads to the formation of hydroquinone by heat is present in the admixture.

9. A photoimaging composition according to claim 1 wherein a redox couple of a photoactivatable oxidant component is present.

10. A photoimaging composition according to claim 9 wherein the photoactivatable oxidant component is a polynuclear quinone absorbing principally in the 430 nm to 550 nm region.

11. A photoimaging composition according to claim 9 wherein the reductant component is an acyl ester of triethanolamine of the formula $$N(CH_2CH_2OC(=O)-R)_3$$

where R is alkyl of 1 to 4 carbon atoms.

12. A photoimaging composition according to claim 9 wherein an acid or acid-supplying compound and an energy-transfer dye are present.

13. A photoimaging composition according to claim 9 having present at least one leuco dye which has one to two removable hydrogens, the removal of which forms a differently colored compound, with the proviso that when the leuco form has only one removable hydrogen and the resultant dye is cationic, there is also present a mineral acid, organic acid or acid-supplying compound which forms a salt with the leuco form of the dye.

14. A photoimaging composition according to claim 9 wherein the leuco dye is the salt of an acid in leuco form of a triphenylmethane dye having, in at least two of the phenyl rings positioned para to the methane carbon atom, a substituent selected from the group consisting of amino, and $C_1$ to $C_4$ dialkylamino groups, the acid being a mineral acid, an organic acid, or an acid-supplying compound.

15. A photoimaging composition according to claim 7 wherein a redox couple of a photoactivatable oxidant component is present.

16. A photoimaging composition according to claim 7 having present at least one leuco dye which has one to two removable hydrogens, the removal of which forms a differently colored compound, with the proviso that when the leuco form has only one removable hydrogen and the resultant dye is cationic, there is also present a mineral acid, organic acid or acid-supplying compound which forms a salt with the leuco form of the dye.

17. A photoimaging composition according to claim 16 wherein the leuco dye is the salt of an acid in leuco form of a triphenylmethane dye having, in at least two of the phenyl rings positioned para to the methane carbon atom, a substituent selected from the group consisting of amino, and $C_1$ to $C_4$ dialkyl amino groups, the acid being a mineral acid, an organic acid, or an acid-supplying compound.

18. A photoimaging composition according to claim 7 wherein a film-forming polymeric binder is present.

19. A photoimaging composition according to claim 18 wherein the polymeric binder is cellulose acetate butyrate.

20. A photoimaging composition according to claim 7 wherein a precursor of hydroquinone which leads to the formation of hydroquinone by heat is present in the admixture.

21. A photoimaging composition according to claim 15 wherein the photoactivatable oxidant component is a polynuclear quinone absorbing principally in the 430 nm to 550 nm region.

22. A photoimaging composition according to claim 15 wherein the reductant component is an alcyl ester of triethanolamine of the formula $$N(CH_2CH_2O\overset{\overset{\displaystyle O}{\|}}{C}-R)_3$$

where R is alkyl of 1 to 4 carbon atoms.

23. A photoimaging composition according to claim 15 wherein an acid or acid-supplying compound and an energy-transfer dye are present.

24. A photoimaging composition according to claim 15 having present at least one leuco dye which has one to two removable hydrogens, the removal of which forms a differently colored compound, with the proviso that when the leuco form has only one removable hydrogen and the resultant dye is cationic, there is also present a mineral acid, organic acid or acid-supplying compound which forms a salt with the leuco form of the dye.

25. A photoimaging composition according to claim 15 wherein the leuco dye is the salt of an acid in leuco form of a triphenylmethane dye having, in at least two of the phenyl rings positioned para to the methane carbon atom, a substituent selected from the group consisting of amino, and $C_1$ to $C_4$ dialkyl-amino groups, the acid being a mineral acid, an organic acid, or an acid-supplying compound.

* * * * *